US008312588B2

(12) United States Patent
Yamaguchi et al.

(10) Patent No.: US 8,312,588 B2
(45) Date of Patent: Nov. 20, 2012

(54) CLEANING FABRIC AND WINDOW SCREEN CLEANER

(75) Inventors: Tosirou Yamaguchi, Osaka (JP); Toshikazu Ohyama, Gyoda (JP)

(73) Assignees: Maru-T Ohtsuka Corp., Tokyo (JP); Linzer Products Corp., Wyandanch, NY (US)

( * ) Notice: Subject to any disclaimer, the term of this patent is extended or adjusted under 35 U.S.C. 154(b) by 647 days.

(21) Appl. No.: 12/404,379

(22) Filed: Mar. 16, 2009

(65) Prior Publication Data

US 2009/0271938 A1 Nov. 5, 2009

Related U.S. Application Data

(60) Provisional application No. 61/071,546, filed on May 5, 2008.

(30) Foreign Application Priority Data

Apr. 30, 2008 (JP) ..... 2008-118960

(51) Int. Cl.
*B44D 5/00* (2006.01)

(52) U.S. Cl. ..... 15/230.11; 15/208; 15/230

(58) Field of Classification Search ..... 15/208, 15/230, 230.11
See application file for complete search history.

(56) References Cited

U.S. PATENT DOCUMENTS

| | | | | |
|---|---|---|---|---|
| 5,377,378 | A * | 1/1995 | Cutler | 15/230 |
| 6,733,881 | B2 * | 5/2004 | Kasabo et al. | 428/364 |
| 7,021,085 | B2 * | 4/2006 | Ikeda et al. | 66/191 |
| 2007/0006413 | A1 * | 1/2007 | Lee | 15/228 |

FOREIGN PATENT DOCUMENTS

| | | |
|---|---|---|
| JP | 11-276399 | 10/1999 |
| JP | 2000-350689 | 12/2000 |
| JP | 2002-017619 | 1/2002 |
| JP | 2002-88581 | 3/2002 |
| JP | 2005-320654 | 11/2005 |
| JP | 2006-055240 | * 3/2006 |
| JP | 2008-93238 | 4/2008 |

* cited by examiner

*Primary Examiner* — Lee D Wilson
*Assistant Examiner* — Shantese McDonald
(74) *Attorney, Agent, or Firm* — Oblon, Spivak, McClelland, Maier & Neustadt, L.L.P.

(57) ABSTRACT

A window-screen-cleaning fabric comprises a base cloth and a plurality of fibers comprising (A) a crimped fiber and (B) a flat fiber. In the fabric, the crimped fibers and the flat fibers are raised from a first surface of the base cloth, and the height of the flat fibers from the first surface of the base cloth is greater than that of the crimped fibers from the first surface of the base cloth.

7 Claims, 4 Drawing Sheets

CLEANING FABRIC AND WINDOW SCREEN CLEANER

FIELD OF THE INVENTION

The present invention relates to a cleaning fabric for a window screen (or a screen, a mesh screen) and the like, and a window screen cleaner comprising the cleaning fabric.

BACKGROUND OF THE INVENTION

A method for cleaning a window screen includes a water washing of a window screen removed from a window frame, a wiping of a window screen with a towel or wiper, and others. In order to clean a window screen more efficiently, a method using a special window screen cleaner has been proposed. Among the methods using such a window screen cleaner, a method using a cleaning fabric (or a wiping cloth) having raised (or brushed) fibers from a surface thereof has been known as a method for cleaning a window screen by allowing the fibers to penetrate a mesh of the window screen.

For example, Japanese Patent Application Laid-Open No. 17619/2002 (JP2002-17619A (Claim 1 and Paragraph Nos. [0013] to [0018])) suggests a wiping cleaner comprising a base part equipped with a controlling handle, and a flocked fabric disposed in an undersurface side of the base part. In the cleaner, the flocked fabric has piles densely flocked approximately perpendicular to a base cloth, a cleaning sheet is wrapped around the flocked fabric. A substance existing on an area to be cleaned is collected by the cleaning sheet. This document discloses a flocked fabric in which a pile of a polyamide having a fineness of 17 to 65 dtex is transplanted to a base cloth comprising a polyester nonwoven fabric by electrostatic transplantation.

However, the cleaning sheet cannot remove dust or dirt from a mesh net sufficiently. In addition, the water-wash cleaning with the wiping cleaner causes scattering of dirty water. Further, the cleaning sheet has a low durability, for example, due to falling off (or slipping off) of the flocked pile.

Moreover, Japanese Patent Application Laid-Open No. 55240/2006 (JP-2006-55240A (Claims 1 and 5, Paragraph Nos. [0014], [0027], and FIGS. 2 to 5)) proposes a window screen cleaner which comprises a roller having a cleaning fabric covered around a surface of the roller, and a handle equipped with the roller. The cleaning fabric has a cut pile raised from a cleaning surface thereof, and the cut pile has a percentage of crimp of 5 to 30%. This document mentions that the fineness of the cut pile is preferably 0.1 to 10 dtex and more preferably 0.3 to 5 dtex. Moreover, the document discloses a moquette comprising a cut pile and a raised yarn having a shorter length and a higher percentage of crimp than the cut pile has as the cleaning fabric.

However, the window screen cleaner also has an insufficient cleaning performance since the cut pile yarn poorly scrapes dust or dirt off the mesh. Further, when the roller rolls with water for cleaning, dirty water is scattered. Therefore, the window screen cleaner has a cover for preventing scattering of dirty water, the cover being attached thereon.

SUMMARY OF THE INVENTION

It is therefore an object of the present invention to provide a fabric which can clean a window screen easily and efficiently and a window screen-cleaner comprising the fabric.

Another object of the present invention is to provide a fabric (a cleaning fabric) which can inhibit scattering of dirty water even when the fabric is attached to a roller for cleaning a window screen by rotating the roller, and a window screen cleaner comprising the fabric.

The inventors of the present invention made intensive studies to achieve the above objects and finally found that a fabric comprising a crimped fiber group and a flat fiber group longer than the crimped fiber group, both fiber groups being raised from a surface of the fabric, can clean a window screen (or a screen, a mesh screen) easily and efficiently. The present invention was accomplished based on the above findings.

That is, the cleaning fabric (or window-screen-cleaning fabric or cloth) of the present invention comprises a base cloth and a plurality of fibers comprising (A) a crimped fiber and (B) a flat fiber. In the cleaning fabric, the crimped fibers and the flat fibers are raised from a first surface of the base cloth, and the height of the flat fibers from the first surface of the base cloth is greater than that of the crimped fibers from the first surface of the base cloth. The height of the crimped fibers (A) may be almost uniform, the average height of the crimped fibers (A) may be 2 to 10 mm, the height of the flat fibers (B) may be almost uniform, and the average height of the flat fibers (B) may be 1 to 5 mm larger than the average height of the crimped fibers (A). The crimped fiber (A) may comprise a hydrophilic fiber having a fineness of single fiber of not more than 5 dtex and a percentage of crimp of about 5 to 30%. The flat fiber (B) may comprise a monofilament having a fineness of about 100 to 500 dtex and an average aspect ratio of about 2 to 100, wherein the average aspect ratio means a ratio of a length in a width direction relative to a length in a thickness direction of a cross-sectional form perpendicular to a longitudinal direction of the fiber. The base cloth may comprise a woven or knitted fabric, the crimped fiber (A) may comprise a cut pile yarn of a multi-filament, and the flat fiber (B) may comprise a cut pile yarn of a monofilament. In the fabric of the present invention, the crimped fiber (A) and the flat fiber (B) may be arranged for forming a pair of an array of the crimped fiber (A) and an array of the flat fiber (B) adjacent to each other, and the arrays may be arranged parallely with each other at intervals.

The present invention also includes a window screen cleaner which comprises the fabric, a roller having the fabric wrapped therearound, and a handle member having a crooked rod attached to the roller, wherein the roller is rotatable about a rotation axis thereof. In the window screen cleaner, the base cloth has a first engaging element formed on a second surface thereof and having a female structure of a separable fastener, the roller has a second engaging element formed on an outer surface thereof and having a male structure of the separable fastener, and the fabric is detachably attached to the roller with an aid of an engagement of the first and second elements.

Incidentally, in this specification, the term "multi-filament" means a single yarn formed of a bundle of a plurality of (at least two) filaments.

DETAILED DESCRIPTION OF THE INVENTION

[Cleaning Fabric]

Figure 1:
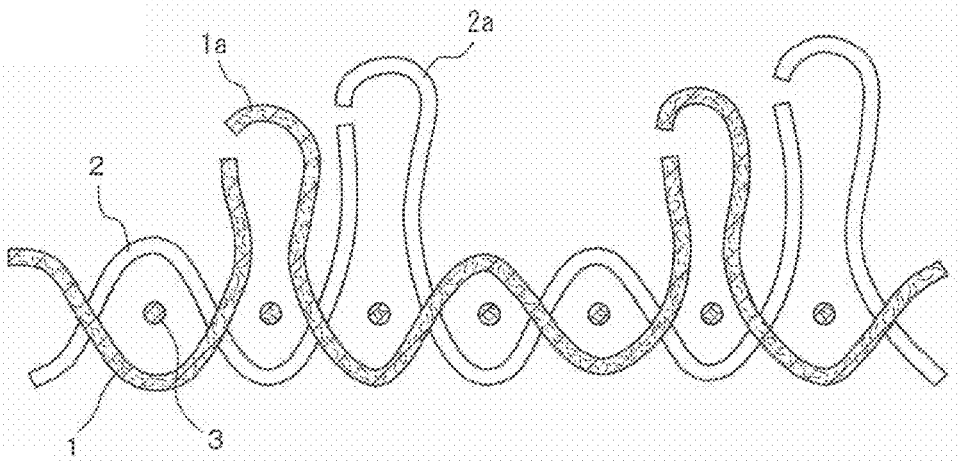
FIG. 1 represents a schematic cross-sectional view for illustrating an example of a structure of ground yarns and cut pile yarns in the cleaning fabric of the present invention.

The cleaning fabric (or cloth) of the present invention is a fabric (or cloth) for cleaning a window screen and comprises a base cloth and a plurality of fibers (fiber group or fiber array) raised from a surface (or a first surface) of the base cloth. Incidentally, the cleaning fabric of the present invention is particularly suitable for cleaning a window screen. The cleaning fabric of the present invention may also be used for cleaning other subjects, for example, a net structure (e.g., a wire mesh, a wire netting) and a fiber structure.

(Base Cloth)

The base cloth is not particularly limited to a specific one as long as the base cloth is a cloth or fabric having a flexibility (softness) so as to clean a window screen efficiently. The base cloth may be a nonwoven fabric. The base cloth is preferably a woven or knitted fabric in order to raise a nap on a surface thereof easily and stably. For example, a plain weave fabric may be used as the woven fabric. A fabric having raised fibers woven in and united with a base cloth (e.g., a moquette, a velvet, and a corduroy) may preferably be used. For example, a plain stitch fabric, a rib stitch fabric, an interlock fabric, or the like may be used as the knitted fabric. A fabric having raised fibers knitted in and united with a base cloth (e.g., a tricot fabric, a raschel fabric, and a sinker velour) may preferably be used.

The fiber to be contained in the base cloth may be a staple fiber in the case of a nonwoven fabric. A fiber constituting a woven or knitted fabric or cloth is a continuous filament or yarn. Moreover, the fiber may be a monofilament yarn or is preferably a multi-filament yarn or a spun yarn in order to improve the flexibility of the base cloth. The fineness of the fiber (in the case of a multi-filament yarn, the fineness of the multi-filament yarn) is, for example, about 10 to 500 dtex, preferably about 50 to 400 dtex, and more preferably about 100 to 350 dtex. The fineness of single fiber of the multi-filament is not particularly limited to a specific one and is, for example, about 1 to 20 dtex, preferably about 2 to 10 dtex, and more preferably about 3 to 5 dtex. The number of multi-filaments is, for example, about 10 to 200, preferably about 20 to 150, and more preferably about 30 to 100.

The fiber to be contained in the woven or knitted fabric may include, for example, a natural fiber, a synthetic fiber, a semi-synthetic fiber, and a regenerated fiber. These fibers may be used alone or in combination.

The natural fiber may include, for example, a plant fiber such as cotton or flax, and an animal fiber such as silk, wool, angora, cashmere, mohair, camel, alpaca, or feather.

The synthetic fiber may include, for example, a polyester-series fiber (e.g., a poly(alkylene arylate) fiber such as a poly(ethylene terephthalate) fiber, a poly(trimethylene terephthalate) fiber, a poly(butylene terephthalate) fiber, or a poly(ethylene naphthalate) fiber, and an aliphatic polyester-series fiber such as a poly(lactic acid) fiber), a polyamide-series fiber (e.g., an aliphatic polyamide-series fiber such as a polyamide 6 fiber, a polyamide 66 fiber, a polyamide 11 fiber, a polyamide 12 fiber, a polyamide 610 fiber, or a polyamide 612 fiber, an alicyclic polyamide-series fiber, an aromatic polyamide-series fiber such as a poly(phenylene isophthalamide fiber), a poly(hexamethylene terephthalamide fiber), or a poly(p-phenylene terephthalamide) fiber), a polyolefin-series fiber (e.g., a poly$C_{2-4}$olefin fiber such as a polyethylene fiber or a polypropylene fiber), an acrylic fiber (e.g., a acrylonitrile-series fiber having an acrylonitrile unit, such as an acrylonitrile-vinyl chloride copolymer fiber), a poly(vinyl alcohol)-series fiber (e.g., an ethylene-vinyl alcohol-series copolymer fiber), a poly(vinyl chloride)-series fiber (e.g., a fiber of a poly(vinyl chloride), a vinyl chloride-vinyl acetate copolymer fiber, or a vinyl chloride-acrylonitrile copolymer fiber), and a poly(vinylidene chloride)-series fiber (e.g., a fiber of a vinylidene chloride-vinyl chloride copolymer or a vinylidene chloride-vinyl acetate copolymer).

The semisynthetic fiber may include, for example, an acetate fiber such as a triacetate fiber, and a promix fiber.

The regenerated fiber may include, for example, a cellulose-series regenerated fiber such as rayon, polynosic, or cupra.

Among these fibers, the polyester-series fiber, the polyamide-series fiber, the polyolefinic fiber, the poly(vinyl alcohol)-series fiber, the cellulose-series fiber such as the acetate fiber or the regenerated fiber, and others are widely used. In particular, for meeting strength and flexibility required for the base cloth, a poly(alkylene arylate)-series fiber such as a poly(ethylene terephthalate) fiber or a poly(butylene terephthalate) fiber, an aliphatic polyamide-series fiber such as a polyamide 6 fiber or a polyamide 66 fiber, and others are preferred.

Incidentally, a binder fiber may be contained as part of the fiber constituting the base cloth for reinforcing the fiber to be raised. Examples of the binder fiber include a fiber made of a resin having a relatively low melting point (e.g., an amorphous polyester-series fiber, a polyamide-series fiber, a polyethylene-series fiber, and a polyurethane-series fiber).

(A Plurality of Fibers Raised from Surface of Base Cloth)

A plurality of fibers raised from the first surface of the base cloth (a raised region) may be fibers which are fixed on the first surface of the base cloth with an adhesive or the like by means of an electrostatic transplantation or the like. In order to improve stability or production of the base cloth, the fibers raised from the first surface of the base cloth are preferably a cut pile yarn. In regions other than the raised region, the cut pile yarn constitutes part of the base cloth by being usually knitted or woven into the base cloth as a woven or knitted fabric.

In the present invention, such a plurality of fibers comprise (A) a crimped fiber and (B) a flat fiber.

(A) Crimped Fiber

Fibers exemplified as the fiber for the above-mentioned base cloth may be used as the crimped fiber (A). In order to keep water for cleaning a window screen and prevent scattering of dirty water efficiently, a hydrophilic fiber is preferable. A fiber comprising at least a hydrophilic polymer may be used as the hydrophilic fiber.

The hydrophilic polymer may include, for example, a cellulose-series resin (a $C_{1-3}$alkyl cellulose ether such as a methyl cellulose, a hydroxy$C_{2-4}$alkyl cellulose ether such as a hydroxyethyl cellulose, and a carboxy$C_{1-3}$alkyl cellulose ether such as a carboxymethyl cellulose), a poly(alkylene glycol) resin (e.g., a poly($C_{2-4}$alkylene oxide) such as a poly (ethylene oxide) or a poly(propylene oxide)), a polyvinyl-series resin (e.g., a polyvinylpyrrolidone, a poly(vinyl ether), a poly(vinyl alcohol), and a poly(vinyl acetal)), an acrylic copolymer and an alkali metal salt thereof (e.g., a copolymer containing an acrylic monomer unit such as (meth)acrylic acid, a (meth)acrylate such as hydroxyethyl(meth)acrylate, or (meth)acrylamide), a vinyl-series copolymer or an alkali metal salt thereof [e.g., a copolymer of a vinyl-series monomer (such as isobutylene, styrene, ethylene, or vinyl ether) and an unsaturated carboxylic acid or an anhydride thereof (such as maleic anhydride)], and a resin having a substituent which imparts solubility thereto or an alkali metal salt thereof (e.g., a polyester or polyamide having a group such as a sulfonic acid group, a carboxyl group, a hydroxyl group, or a polyoxyethylene group). These hydrophilic polymers may be used alone or in combination. Among these hydrophilic polymers, the poly(vinyl alcohol)-series polymer such as a poly (vinyl alcohol), particularly, a hydrophilic thermoplastic poly (vinyl alcohol)-series polymer such as an ethylene-vinyl alcohol copolymer, is preferred since such a copolymer has a high hydrophilicity and stability for melt spinning. The ethylene content in the ethylene-vinyl alcohol copolymer is, for example, about 20 to 80 mol %, preferably about 25 to 70 mol %, and more preferably about 30 to 60 mol %.

The hydrophilic fiber may be a fiber comprising a hydrophilic polymer alone (e.g., a rayon, an acetate fiber, and an ethylene-vinyl alcohol copolymer fiber) or a conjugated (or composite) fiber comprising a hydrophilic polymer and a hydrophobic polymer (e.g., a polyester-series resin, a polyamide-series resin, and a polyolefinic resin). The conjugated (or composite) form of the conjugated fiber may include a sheath-core form, an islands-in-the-sea form, a blended form, a parallel form (a side-by-side form or a multi-layer laminated form), a radial form (a radially-laminated form), a hollow radial form, a block form, a random composite form, and others. The conjugated form is not particularly limited to a specific one as long as a phase comprising the hydrophilic polymer is exposed to the fiber surface. For example, such a fiber may be a fiber having a multi-layer laminated form comprising a poly(alkylene arylate)-series resin (such as a poly(ethylene terephthalate) or a poly(butylene terephthalate)) and an ethylene-vinyl alcohol copolymer.

The fineness of single fiber of the crimped fiber (A) is not larger than 5 dtex and may be selected from the range of about 0.01 to 5 dtex. Further, the average value of the fineness of single fiber is, for example, about 0.01 to 3 dtex, preferably about 0.03 to 2 dtex, and more preferably about 0.05 to 1 dtex (particularly about 0.1 to 0.5 dtex). The crimped fiber (A) having such a small fineness has a lot of crimps easily developed and can impart fiber stiffness sufficient for scraping dust or dirt off by the flat fiber (and the crimped fiber) and improve in water retentivity.

The percentage of crimp of the crimped fiber (A) is, for example, about 1 to 60%, preferably about 2 to 50%, and more preferably about 3 to 30% (particularly about 5 to 20%). The fiber having such a percentage of crimp has a useful elasticity for wiping. The elasticity is mainly useful for scraping off dust or dirt by the flat fiber. In addition, such a fiber forms a microcrimped net structure which allows a high water retentivity.

The crimped fiber (A) may be a monofilament. In order that a cut pile yarn of the crimped fiber (A) can scrape dust or dirt off efficiently and enhance the density of a raised region easily, the crimped fiber (A) is preferably a multi-filament. In the case of the multi-filament, developed microcrimped fibers easily entangle with each other to form a net structure, enhance the fiber-aggregation density of the raised region to impart the stiffness to the flat fiber, and improve the water retentivity. In particular, in the present invention, a flocculent net structure comprising the hydrophilic fiber can be formed by crimping the aforementioned hydrophilic fiber and can retain water enough. Therefore, the present invention can inhibit scattering of dirty water in cleaning a window screen.

The number of single fibers (monofilaments) contained in the multi-filament is not particularly limited to a specific one as long as several single fibers (or at least two single fibers) are contained therein. The number of single fibers is, for example, about 10 to 500, preferably about 20 to 400, and more preferably about 30 to 300 (particularly about 50 to 200).

The multi-filament is preferably false-twisted for developing crimps. In order to ensure the above-mentioned percentage of crimp, a conventional method may be adopted as a method for false-twisting. For example, the method may suitably be selected depending on the fineness or the species of materials. In a multi-filament having a fineness of 30 to 200 dtex (particularly 50 to 150 dtex)/10 to 30 filaments, the false-twist conditions may be defined as a false-twist number of about 1000 to 5000 T/m (particularly about 2000 to 4000 T/m), a first heater temperature of about 100 to 260° C. (particularly about 120 to 200° C.), a second heater temperature of about 100 to 200° C. (particularly about 120 to 180° C.), and a yarn speed of about 100 to 500 m/minute (particularly about 200 to 400 m/minute). In order to adjust the fineness of yarn, the obtained several false-twisted yarns (for example, 2 to 10 yarns, particularly 2 to 5 yarns) may further be bundled. The fineness of the multi-filament is, for example, about 10 to 1000 dtex, preferably about 50 to 800 dtex, and more preferably about 100 to 500 dtex.

The cross-sectional form of the crimped fiber (A) (a form or shape of a cross section perpendicular to the length direction of the fiber) may include not only a common solid-core cross section such as a circular cross section or a deformed (or modified) cross section [e.g., a flat form, an oval (or elliptical) form, a polygonal form, a multi-leaves form from tri-leaves to 14-leaves, a T-shaped form, an H-shaped form, a V-shaped form, and a dog-bone form (I-shaped form)] but also a hollow cross-section. The cross-sectional form is usually a circular cross section, a flat form, an oval (or elliptical) form, and others. Incidentally, the cross-sectional form of the crimped fiber (A) may be a non-flat form, and the crimped fiber (A) may have an average aspect ratio of less than 2, e.g., about 1 to 1.8, preferably about 1 to 1.5, and more preferably about 1 to 1.2.

The average height of the crimped fiber (A) is, for example, about 2 to 10 mm, preferably about 2.5 to 9 mm, and more preferably about 3 to 8 mm. In the present invention, since the average height of the after-mentioned flat fiber (B), which is stiffer than the crimped fiber (A), is larger than that of the crimped fiber (A), the stiffer flat fiber (B) efficiently shows the ability to scrape dust or dirt off the mesh.

The height of the crimped fibers (A) is almost uniform. Such fibers, each having a uniform height, can easily be produced, for example, by uniforming the length of loops of cut pile yarns.

(B) Flat Fiber

The flat (tape-like or film-like) fiber (B) is not particularly limited to a specific one as long as the cross-sectional form of the fiber is a flat form. The flat fiber may be a multi-filament having two or more monofilaments. The flat fiber is preferably a monofilament. The fibers exemplified as the fiber for the above-mentioned base cloth may be used as the flat fiber (B). For example, a polyester-series fiber, a polyamide-series fiber, and a polyolefinic fiber are generally used. Among them, in order to develop a moderate stiffness, a poly(alkylene arylate)-series fiber such as a poly(ethylene terephthalate) or a poly(butylene terephthalate), an aliphatic polyamide-series fiber such as a polyamide 6 or a polyamide 66 fiber, a polypropylene-series fiber such as a polypropylene fiber, and the like are preferable. In particular, when the flat fiber protruded from a surface of the base cloth comprises a high transparent resin, the fiber gives a gloss to the surface by reflection of light, thereby imparting a decorative effect to the fabric.

The fineness of single fiber of the flat fiber (B) is larger than that of the crimped fiber (A). The fineness of single fiber of the flat fiber (B) is, for example, about 50 to 1000 dtex, preferably about 100 to 500 dtex, and more preferably about 200 to 450 dtex (particularly about 250 to 400 dtex). The flat fiber (B) having such a fineness easily is allowed to penetrate a commercially available mesh net having a pore size of about 1 to 3 mm, is easily entangled in the mesh net, and has a moderate stiffness for scraping dust or dirt off the mesh net.

The cross-sectional form of the flat fiber (B) (the cross-section in a direction perpendicular to the longitudinal direction of the fiber) may be hollow as long as the cross-sectional form is a flat form. The cross-sectional form is usually a solid and flat form (for example, a linear form, a rectangular, an oval (or elliptical) form, and an elliptic form).

In the cross-sectional form of the flat fiber (B), the average length of the width direction (in the case of an oval or elliptic form, the major axis) is, for example, about 20 to 3000 μm, preferably about 100 to 2000 μm, and more preferably about 200 to 1500 μm (particularly about 300 to 1000 μm). The flat fiber having such a fiber width is easily entangled in a mesh at a tip side and both sides of the fiber, and easily scrapes dust or dirt off the mesh.

In the cross-sectional form of the flat fiber (B), the average length of the thickness direction (in the case of an oval or elliptic form, the minor axis) is, for example, about 1 to 300 μm, preferably about 5 to 100 μm, and more preferably about 10 to 80 μm (particularly about 20 to 50 μm). The flat fiber having such a thickness has a moderate stiffness and can scrape dust or dirt off the mesh sufficiently.

The average aspect ratio (the length of the width direction/the length of the thickness direction) of the cross-sectional form of the flat fiber (B) represents a degree of flatness and is, for example, about 2 to 100, preferably about 3 to 50, and more preferably about 5 to 30. The flat fiber having such an aspect ratio can retain a sufficient stiffness to scrape dust or dirt off the mesh. In addition, the fiber is easily allowed to penetrate a mesh at a tip side and both sides of the fiber and sufficiently scrapes dust or dirt off the mesh. Further, probably because the flat fiber is entangled in the mesh with a high repellent force due to the stiffness of the fiber, only one-sided cleaning of the mesh ensures removal of dust or dirt from the other side of the mesh.

The average height of the flat fiber (B) is greater than that of the crimped fiber (A) and is, for example, about 3 to 15 mm, preferably about 4 to 14 mm, and more preferably about 4 to 13 mm. With respect to the difference in average height between these fibers (A) and (B), for example, it is preferable that the average height of the flat fiber (B) be about 1 to 5 mm, preferably about 1.2 to 4 mm, and more preferably 1.5 to 3 mm (particularly about 1.8 to 2.5 mm) larger than that of the crimped fiber (A). The difference in height between these fibers (A) and (B) can usually be produced by contraction (or shrinkage) of the crimped fiber (A) due to crimp development.

The height of the flat fibers (B) is almost uniform. In the same manner as in the crimped fiber (A), the flat fibers, each having a uniform height, can easily be produced, for example, by uniforming the length of loops of cut pile yarns.

(Structure of Cleaning Fabric and Production Process of Cleaning Fabric)

In the cleaning fabric of the present invention, the crimped fibers (A) and the flat fibers (B) are raised from the first surface of the base cloth. The arrangement of the plurality of raised fibers is not particularly limited to a specific one as long as both fibers (A) and (B) are moderately mixed in the arrangement.

In particular, when the fabric is a woven or knitted fabric, the arrangement of the raised fibers may be regular. For example, the raised crimped fiber (A) and the raised flat fiber (B) may be arranged alternately. Further, in order to adjust the density of the raised region, the raised fibers (A) and (B) may be arranged at regular intervals. For example, the raised fibers may be arranged to form arrays, and the arrays may be arranged in parallel with each other at regular intervals. When the crimped fiber (A) is a multi-filament, a cut pile yarn of the crimped fiber (A) is split into monofilaments. Therefore, the adjustment of the density of the raised region by arranging the fibers at regular intervals is desirable. Concretely, the fabric in which the density of the raised region is adjusted can easily be produced by weaving or knitting so that loops for cut pile yarns are arranged at intervals.

Figure 2:
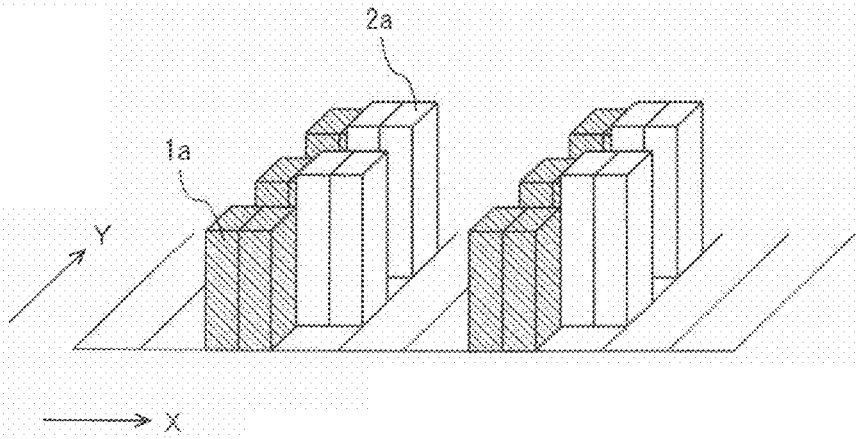
FIG. 2 represents a schematic view for illustrating an arrangement relationship of cut pile yarns raised from a first surface of the fabric represented in FIG. 1.

Specifically, an example of the arrangement of cut pile yarns for forming a raised surface of the woven or knitted fabric will be illustrated with a figure. FIG. 1 represents a schematic cross-sectional view for illustrating an example of a structure of ground yarns and cut pile yarns in the cleaning fabric of the present invention. FIG. 2 represents a schematic view for illustrating an arrangement relationship of cut pile yarns raised from the first surface of the fabric represented in FIG. 1.

The fabric illustrated by this example comprises a base cloth knitted (or woven) from a ground yarn 3. Further, a crimped pile yarn 1 formed of the crimped fiber (A) and a flat pile yarn 2 formed of the flat fiber (B) are knitted in the base cloth. Each of the crimped pile yarn 1 and the flat pile yarn 2 is knitted in the base cloth in a direction in parallel with X-direction of the base cloth in FIG. 2, these knitted yarns 1 and 2 being adjacently arranged. More specifically, the crimped pile yarn 1 is knitted in a stitch (or texture) of the ground yarn 3, and the flat pile yarn 2 is knitted in another stitch (or texture) adjacent to the stitch (or texture) in Y-direction (each of the crimped pile yarn 1 and the flat pile yarn 2 is alternately knitted in a stitch in the base cloth). Moreover, with respect to the crimped pile yarn 1, a loop for forming a crimped cut pile yarn 1*a* is formed at every other stitch of the knitted pile yarn 1, and with respect to the flat pile yarn 2, a loop for forming a flat cut pile yarn 2*a* is formed at every other stitch of the knitted pile yarn 2. That is, these loops are formed at every other two stitches of the ground yarn 3. As a result, the crimped cut pile yarn 1*a* formed of the crimped fiber (A) and the flat cut pile yarn 2*a* formed of the flat fiber (B) are arrayed alternately in Y-direction to form a pattern of a pair of the cut pile yarns 1*a* and 2*a*. The pattern of the pair is arranged to form a pair of an array of the cut pile yarn 1*a* and an array of the cut pile yarn 2*a* in Y direction. Further, the pair arrays are arranged in parallel with Y-direction with an interval corresponding to one stitch in X-direction.

Incidentally, with respect to cutting of the pile yarn, it is uncommon to cut a loop at the center into halves (symmetrically) in an actual fabric. As represented by FIG. 1, the loop is cut at an off-center site, and either tip of the cut pile yarn is often curved. In particular, a curved tip of the flat fiber (B) is entangled in a mesh of a window screen in cleaning, whereby the fiber improves in scraping ability on dust or dirt. Moreover, since the flat fiber (B) has an asymmetrical form, the cut flat fiber (B) moderately changes the raised direction of the fiber. Specifically, each fiber provides a curved tip directed to a random direction by cutting and can scrape dust or dirt off the mesh of the window screen from various directions.

Further, in the Figure, the crimped fiber (A) is represented as a monofilament for convenience. When the crimped fiber (A) is a multi-filament, the crimped fiber (A) has a tuft of monofilaments at least at the tip of the fiber (A). Such a tuft branches into smaller tufts which curve toward various directions. Therefore, in the vicinity of the tip of the fiber, the clearance between the fibers is filled with the tufts in practical cases. In particular, the crimped fiber (A) is contacted or entangled with another crimped fiber (A) arranged adjacent thereto due to a high percentage of crimp of the fiber to form room or space between the fibers. Therefore, the density of the raised region is increased, and the fabric has an improved water absorbing power and water retentivity.

In a typical example of the fabric of the present invention, the surface of the base cloth is covered with the crimped fiber (A), and the flat fiber (B) protrudes from the surface comprising the crimped fiber (A), where the height of the flat fiber (B) is several millimeters longer than that of the crimped fiber (A).

The fabric of the present invention is not particularly limited to such an arrangement. The arrangement may be suitably selected depending on the fineness or number of the crimped fiber (A) and flat fiber (B). The alternate arrangement of the crimped fiber (A) and the flat fiber (B) is not particularly limited to a specific one. For example, the fiber (A) and the fiber (B) may be repeated alternately every 2 to 10 stitches (particularly every 2 to 5 stitches) (that is, bundles of 2 to 10 yarns may be repeated alternately). In the present invention, particularly, 2 to 10 (particularly, 2 to 5) pieces of the crimped fiber (A) and one piece of the flat fiber (B) may be repeated alternately. Moreover, the crimped fiber (A) and the flat fiber (B) may be knitted at intervals of not less than one stitch (e.g., about 1 to 3 stitches) (with skipping over some stitches of the base cloth) of the base cloth without knitting every one stitch of the base cloth. In contrast, in order to obtain a higher density of the raised region relative to base cloth (ground yarn), not less than 2 of the crimped fibers (A) and the flat fiber (B) may be knitted in one stitch. Incidentally, in the case of the woven fabric, both of the crimped fiber (A) and the flat fiber (B) may be woven in warp or weft, or the crimped fiber (A) may be woven in warp (or weft) and the flat fiber (B) may be woven in weft (or warp).

Further, in order to obtain a higher density of the raised region relative to the base cloth (ground yarn), the crimped fiber (A) and the flat fiber (B) may be raised at all stitches without spacing between an array formed of the crimped fiber (A) and an array formed of the flat fiber (B) raised from the surface of the fabric. In contrast, in order to obtain a lower density of the raised region relative to the base cloth (ground yarn), for example, arrays formed of the crimped fiber (A) and the flat fiber (B) may be arranged with a space between the arrays of not less than 2 (e.g., about 2 to 3) stitches depending on the fineness of fibers formed of the base cloth. Namely, loops of pile yarns may be formed every two or more ground yarns, e.g., every 2 to 3 ground yarns. In order to scrape dust or dirt off efficiently and retain water sufficiently, it is preferable to form the loops with a space corresponding to 2 or less stitches.

The proportion of the crimped fiber (A) relative to the flat fiber (B) (in terms of number of fibers before cutting, in the case of cut pile yarn) is not particularly limited to the same proportion (the number of fibers). Depending on fineness or number of each fiber, for example, the proportion (proportion of fiber number), the crimped fiber (A)/the flat fiber (B), may be suitably selected from the range of about 99/1 to 10/90 (e.g., about 97/3 to 30/70), preferably about 95/5 to 50/50, and more preferably about 90/10 to 70/30 (particularly about 85/15 to 75/25). A fabric comprising the both fibers in such a proportion has an excellent balance between mesh-scraping power and water retentivity for retaining dirty water.

The fabric weight of the fabric of the present invention may be, for example, selected from the range of about 500 to 2000 g/m and is preferably about 700 to 1500 g/m and more preferably about 900 to 1300 g/m.

If necessary, the fabric of the present invention may contain an additive such as a coloring agent (e.g., a colorant), a stabilizer (e.g., a heat stabilizer, an ultraviolet stabilizer, a light stabilizer, and an antioxidant), an antibacterial agent, a filler, a fine particle, an antistatic agent, a flame retardant, a plasticizer, a lubricant, or an agent for retarding crystallization rate. These additives may be used alone or in combination. These additives may be contained in any fiber for forming the fabric. In particular, each fiber for forming the fabric (for example, part of the crimped fiber (A)) may contain a coloring agent for coloring. For example, a decorative effect may be imparted to a fabric by knitting or weaving the fabric from colored yarns regularly.

The fabric of the present invention may be produced by a conventional manner. For example, a woven or knitted fabric may be produced by using a conventional knitting machine or weaving loom. In particular, a pile woven or knitted fabric containing a cut pile yarn may be produced by using a loom or machine such as a face-to-face pile loom or a circular knitting machine (for example, a seal fraise knitting machine and a sliver knitting machine). The obtained cut pile woven or knitted fabric may be subjected to a polishing process for removing excess fuzz or subjected to a shearing using a conventional shearing machine for shearing the length (or depth) of the cut pile yarn. Further, the back surface of the fabric may be backcoat-treated (anchor-treated) with an adhesive (for example, a hot melt adhesive such as an acrylic adhesive, an olefinic adhesive, a polyester-series adhesive, a polyamide-series adhesive, or a urethane-series adhesive) by a conventional process.

[Window Screen Cleaner]

The window screen cleaner (screen-cleaner) of the present invention is not particularly limited to a specific one as long as the window screen cleaner comprises the above-mentioned fabric. The window screen cleaner may be used in a mode which in which the fabric itself is utilized like a towel or wiper or may further comprise a sheet-like support plate having the fabric attached thereto and a grip member extended from the support plate. In order to clean a window screen easily and efficiently, the window screen cleaner preferably comprises a roller having the fabric wrapped therearound.

Figure 3:
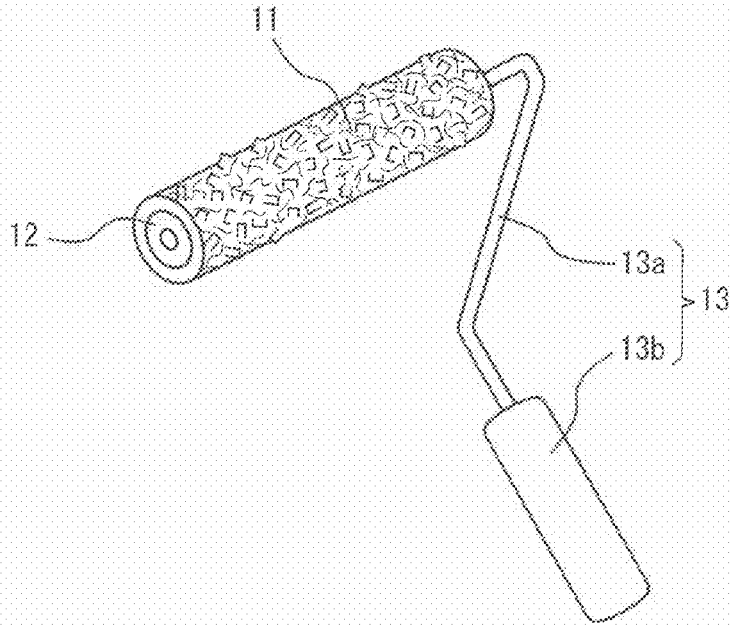
FIG. 3 represents a schematic perspective view for illustrating an example of the window screen cleaner of the present invention.

The window screen cleaner of the present invention using such a roller is described below referring to the attached drawings. FIG. 3 represents a schematic perspective view for illustrating an example of the window screen cleaner of the present invention. The window screen cleaner in this example comprises a cleaning fabric (or a wiping cloth) 11, a cylindrical hollow roller 12 having the fabric 11 wrapped there around, and a handle member 13 attached to the roller 12 to allow the roller 12 to rotate about a rotation axis of the roller. Further, the handle member 13 comprises an arm rod 13*a* and a grip member 13*b* formed at an end of the arm rod 13*a*. Part of the arm rod 13*a* is received in an opening formed along the central axis of the roller 12 to allow the roller 12 to rotate, and the arm rod 13*a* extending from an end of the roller 12 crooks toward a direction crossing with or perpendicular to the rotation axis of the roller.

The fabric 11 is undetachably bonded to a surface (a first surface) of the roller 12 formed of a plastic with a hot melt adhesive. In the Figure, a single fabric (i.e., the fabric 11) is wrapped around the roller. The wrapping manner is not particularly limited to this one. A narrow fabric may be spirally wrapped around the roller, or a plurality of narrow fabrics may be wrapped around the roller.

The roller 12 has a hollow structure and comprises an outer core having the fabric 11 wrapped around a surface thereof and an inner core rotatably attached to the outer core. The rod 13*a* comprises a metal or a plastic and has a circular cross section. The rod 13*a* is received in the axis of the inner core of the roller 12, and the inserted rod 13*a* extends toward the other end. The arm rod 13*a* is fixed to the inner core and is detachable by pulling out from the inner core. This roller 12 is smoothly rotatable around the rod 13*a* as the rotation axis since the inner core is freely rotatable in the roller 12 (outer core). Further, the roller 12 is detachable from the rod 13*a*. Therefore, the dirty fabric 11 after use can easily be washed or cleaned by removing the roller 12 from the rod 13*a*. The roller 12 may be replaced with a new roller. The grip member 13*b* is formed from a plastic or wood and undetachably attached to the rod 13*a*.

In the window screen cleaner, since the fabric 11 is wrapped around the roller 12, which is rotatable around the rotation axis of the roller, a sliding force placed on the mesh of the window screen is small. Therefore, deviation or deterioration of the mesh is inhibited. That is, in cleaning of the window screen with a plane fabric, the mesh is easily deformed due to a frictional force between the fabric and the window screen. On the other hand, in cleaning of the window screen with the roller 12, since the roller 12 being in contact with the mesh rotates to scrape dust or dirt off the mesh of the window screen by the fabric 11 attached to the roller 12, the cleaning can be performed without applying excess loading on the mesh of the window screen.

Figure 4:
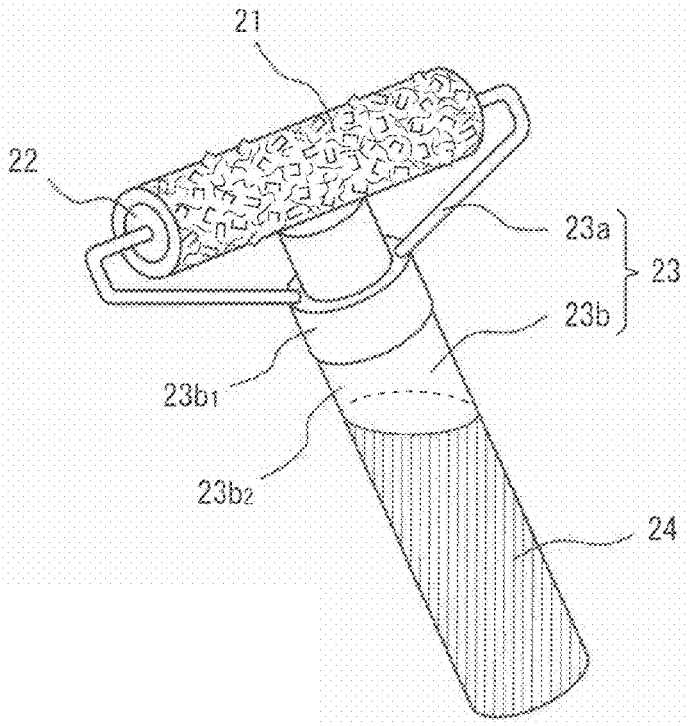
FIG. 4 represents a schematic perspective view for illustrating another example of the window screen cleaner of the present invention.

FIG. 4 represents a schematic perspective view for illustrating another example of the window screen cleaner of the present invention. The window screen cleaner in this example is a window screen cleaner having a handle member capable of containing a cleaning liquid and comprises a cleaning fabric (or a wiping cloth) 21, a roller 22 having the fabric 21 wrapped there around, and a handle member 23 attached to the roller 22 to allow the roller 22 to rotate around the rotation axis of the roller. Further, the handle member 23 comprises a crooked rod 23*a* and a grip member 23*b*. Except for the structure of the rod 23*a* and that of the grip member 23*b*, the configuration of the window screen cleaner in this example is the same as the window screen cleaner represented by FIG. 3.

In this example, the rod 23*a* is extended from the grip member 23*b*, so that the handle member 23 forms a Y-shape. The both ends of the rod 23*a* are crooked to insert in both ends of the roller 22, respectively, thereby fixing the roller 22 rotatably. Moreover, the rod 23*a* is undetachably fixed on the grip member 23*b*, and the grip member 23*b* serves as a grip member for rolling the roller 22. The grip member 23*b* has a hollow structure (a container) capable of containing a liquid and comprises a screw cap $\mathbf{23}b_1$ and a container body $\mathbf{23}b_2$. Therefore, the grip member 23*b* serves not only as a grip member but also as a container for containing a cleaning liquid 24. The top end of the cap $\mathbf{23}b_1$ of the grip member 23*b* (the opening of the container) comprises a porous member such as a cloth (or a fabric), and the cleaning liquid 24 can be supplied to the fabric 21 by tilting the grip member (container). In addition, since the container body $\mathbf{23}b_2$ of the grip member 23*b* comprises a transparent plastic, the residual quantity of the cleaning liquid 24 can visually and easily be confirmed.

In the window screen cleaner of the present invention, the fabric may be fixed to the roller not only with an adhesive but also by being sewn on a cloth constituting the core of the roller. Moreover, the fabric may be detachably fixed (or temporarily fixed) to the roller by using a hook-and-loop fastener, a pressure sensitive adhesive, or others. When the fabric is detachable to the roller, the fabric is easy to exchange or wash (or clean).

Among detachably fixing manners, a manner using a separable fastener (or a hook-and-loop fastener) is preferable since the separable fastener can be easily get on and off, repeatedly used, and has an excellent durability. The separable fastener is not particularly limited to a specific one as long as the back surface of the cleaning fabric (the second surface of the base cloth) and the outer surface of the roller can be engaged with a male-female engagement of the separable fastener. In order to improve the washability and durability of the roller used repeatedly, it is preferable that the fabric is detachably attached to the roller with a male-female engagement of a separable fastener by a first engaging element (a female engaging element) having a female structure (or function) formed on the back surface of the fabric (or the second surface of the base cloth) and a second engaging element (a male engaging element) having a male structure (or function) formed on the outer surface of the roller. Further, the female engaging element in the fabric may be derived from a pile yarn of a woven or knitted fabric having loops (particularly, a pile yarn of a multi-filament), and the male engaging element in the roller may be a male engaging element formed by a hot-melt molding of a thermoplastic resin (i.e., a male element in which a male element made of a thermoplastic resin and a basis comprising the same thermoplastic resin are bonded or attached to form one piece). Such a combination has a high engaging performance, and the male engaging element of the roller, which is often used repeatedly, has excellent washability and durability. Incidentally, in the cleaner from which the fabric is detachable, the rod and the roller may be undetachably attached (or fixed) on or to each other.

The size of the roller is, for example, about 5 to 50 cm (particularly about 15 to 30 cm) in length and about 1 to 6 cm (particularly about 1.5 to 5 cm) in core diameter.

The rotation mechanism of the roller is not particularly limited to a specific one. The rotation mechanism is not limited to a mechanism utilizing a roller which has at least one end having the rod received (or inserted) therein and comprises an inner core and an outer core rotatable around the inner core. A conventional rotation mechanism may be used as the rotation mechanism. For example, a bearing mechanism may be interposed between the inner core and the outer core. Moreover, by reducing the friction between the rod and the roller, or other means, the received (or inserted) rod may be rotated smoothly without the formation of the inner core.

The rod and the roller are not particularly limited to a detachable structure as long as the rod and the roller are fixed rotatably. For example, a window screen cleaner comprising the rod undetachable from the roller and the fabric detachable from the roller prevents the roller from coming off while working, allows the roller to roll stably, and provides easy exchange or washing (or cleaning) of the fabric.

The attachment (or fixing) manner of the rod and the roller may be a manner in which the rod is inserted to an opening formed in the axis of the inner core of the roller, or a manner in which both ends of the rod are attached or fixed to both ends of the inner core (both ends of the axis), respectively, without insertion of the rod to the inner core. In the insertion of the rod to the inner core, the rod may penetrate the inner core, or the rod may be inserted partway in the inner core (without penetrating the inner core). In particular, the Y-shaped handle member of which rod is inserted from both ends of the roller can be attached (or fixed) stably even in the manner in which the rod is inserted without penetrating the inner core or in which both ends of the rod are fixed to both ends of the inner core (both ends of the axis), respectively.

It is not necessary that the grip member and the rod be formed independently of each other. For example, the form of the rod may be changed to give a single-piece member having functions of both the rod and the grip member.

The process for cleaning a window screen by using the window screen cleaner of the present invention is not particularly limited to a specific one. The fabric may be impregnated with water and rolled on a net of a window screen, or the fabric may be rolled on a net of a window screen in a dry form without impregnation with water. Further, a detergent or a cleanser may be added to the water.

Since the cleaning fabric of the present invention comprises a crimped fiber and a protruded flat fiber, thereby cleaning a window screen easily and efficiently. Further, the flat fiber can mainly be allowed to penetrate the mesh of the window screen or entangled in the mesh to scrape dirt or dirt off the mesh, while the crimped fiber, whose height is shorter than that of the flat fiber, retains water therein. Accordingly, the fabric can clean the window screen efficiently with preventing scattering of dirty water. In particular, the fabric can remove dust or dirt sufficiently from both sides of a window screen by cleaning only one side of the window screen.

The cleaning fabric of the present invention and the window screen cleaner comprising the fabric is effectively used for cleaning a window screen to be attached to a window frame of a building structure (such as a residential building or a building).

EXAMPLES

The following examples are intended to describe this invention in further detail and should by no means be interpreted as defining the scope of the invention. In the examples, each of physical properties was determined as follows. Incidentally, "%" in the examples indicates the proportion by weight unless otherwise stated.

(1) Percentage of Crimp (K1)

A sample was wound up to form a skein (or a hank) having a fineness of 5500 dtex by using a skein winder. Then a load of 10 g was suspended from the center of the lower end of the skein, and the skein was fixed at the center of the upper end. The skein was treated with a hot water at 90° C. for 30 minutes in a state that a load of 0.009 cN/dtex was applied to the skein. The load of 10 g was then removed from the skein, and the skein was allowed to stand without loading at a room temperature to dryness. Then the load of 10 g was suspended therefrom again, and the skein was allowed to stand for 5 minutes. The length of the yarn was measured, and let the measured length be L1 (mm). Then the load of 10 g was then replaced with a load of 1 kg, and the skein was allowed to stand for 30 seconds. The length of the yarn was measured, and let the measured length be L2 (mm). The K1 value (%) was calculated in accordance with the following formula.

$$K1=[(L2-L1)/L2]\times 100$$

(2) Height of Cut Pile Yarn

A ruler having the minimum scale of 1 mm (a ruler graduated in 1 mm) was inserted between cut pile yarns vertically to the base cloth to measure a length from a root of the cut pile yarn to a tip thereof.

(3) Evaluation of Wiping Property and Usability

A net of 18 mesh made of a polypropylene monofilament (white color) was used to prepare a simple window screen having 200 cm in length and 100 cm in width. The simple window screen was allowed to stand for 3 months in the open air and then used for evaluation tests. The cleaning of the window screen was performed as follows.

Water was stored in a bucket, and a window screen cleaner was immersed in the stored water to impregnate the fabric of the window screen cleaner with water. Then excess water was removed from the window screen cleaner sufficiently until no more water dropped from the window screen cleaner, and the window screen net was cleaned with rolling the window screen cleaner thereon. The cleanliness after cleaning, compared with before cleaning, was visually evaluated on the basis of the following four criteria, and the usability was evaluated on the basis of the following two criteria.

(Wiping Property)

A: Both the front and back sides of the window screen were clean enough.

B: The front side of the window screen was clean enough, but the back side of the window screen was slightly dirty.

C: Both the front and back sides of the window screen were slightly dirty.

D: Both the front and back sides of the window screen were not clean enough.

(Usability)

A: Scattering of the dirty water is prevented.

B: Scattering of the dirty water is not prevented.

Example 1

Figure 5:
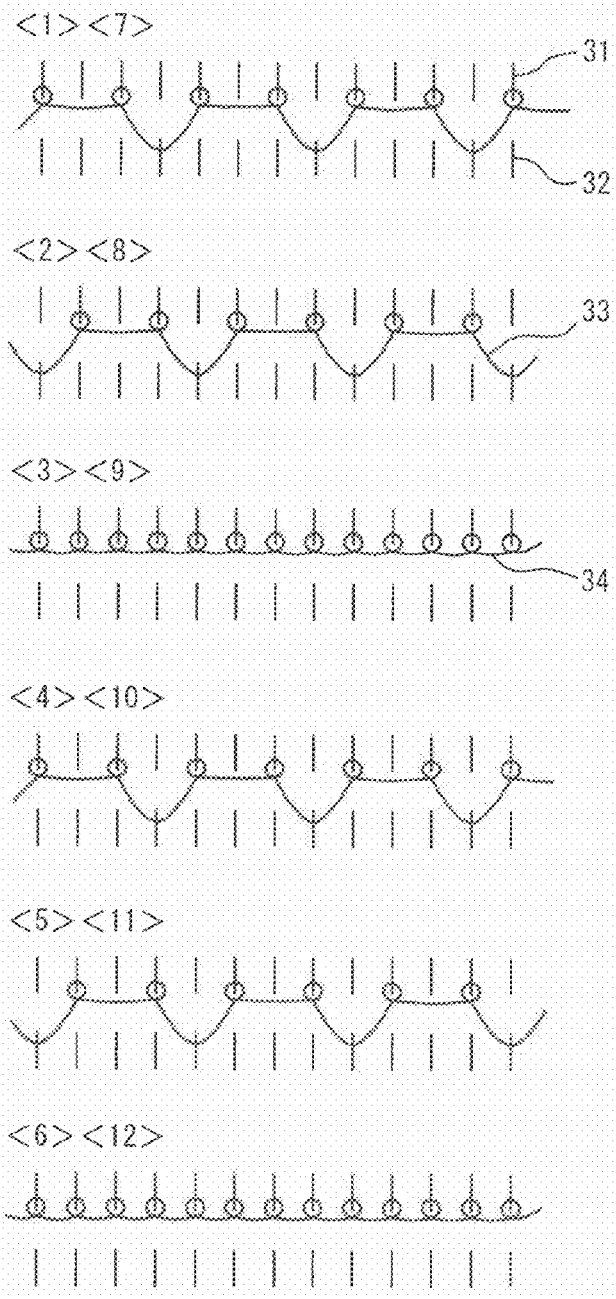
FIG. 5 represents a view of a knitted pattern in the cut pile knitted formation obtained in Example 1.
Figure 6:
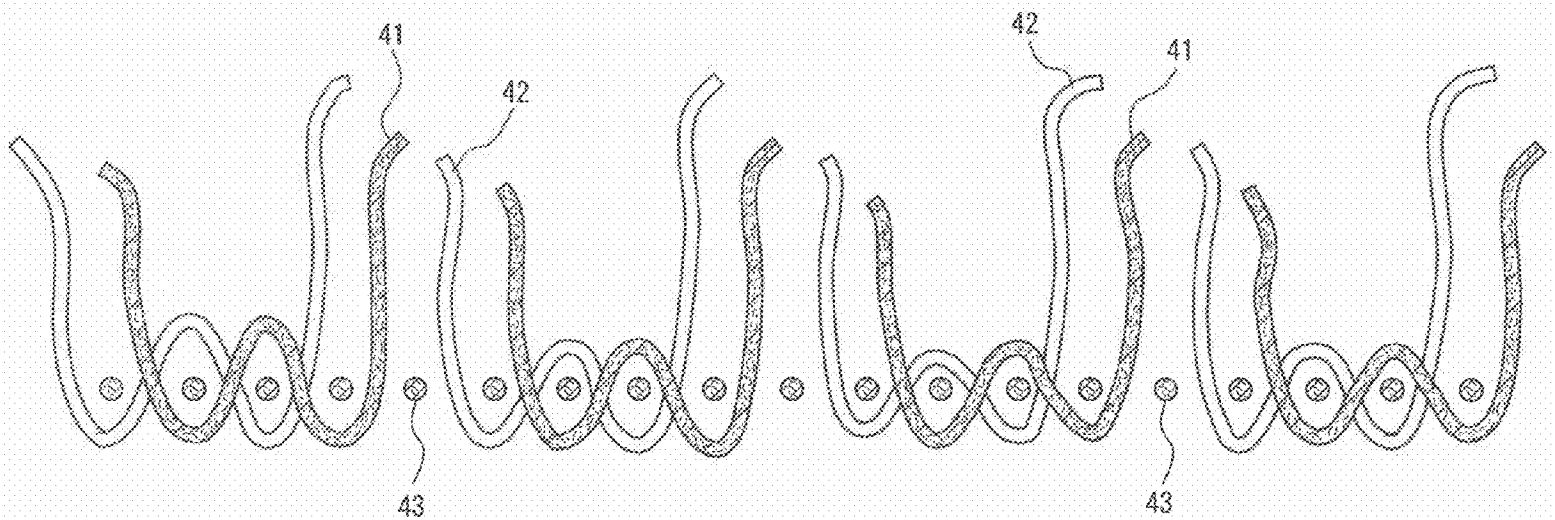
FIG. 6 represents a schematic cross-sectional view for illustrating a structure of ground yarns and cut pile yarns in the cut pile knitted formation obtained in Example 1.

A circular knitting machine (diameter: 20 inches, gauge: 16, and feeder: 12) was used which comprised a cylinder part having hooks for forming piles arranged therein and a dial part having knitting needles for forming a base (or ground) texture and a pile texture arranged therein. The predetermined cut pile length was 9 mm, and knitting was performed with the machine. A cut pile yarn comprising (A) a crimped fiber and (B) a flat fiber was prepared. In the yarn, the crimped fiber (A) was a crimped fiber yarn of 450 dtex/96 filaments obtained by bundling four pieces of false-twist yarn formed of a conjugated fiber (EK110 dtex/24 filaments, "WRAMP" manufactured by Kuraray Co., Ltd., K1 value: 11%, a multi-layer laminated form conjugated fiber comprising an ethylene-vinyl alcohol copolymer and a poly(ethylene terephthalate), the false-twisted fiber yarn having fibers with various fineness of 0.4 to 3.4 dtex mixed therein) by using an air intermingling machine), and the flat fiber (B) was a slit-film yarn made of a poly(ethylene terephthalate) (390 dtex, manufactured by Toray Industries, Inc., 750 μm in width of cross-sectional form and 38 μm in thickness). Moreover, a poly(ethylene terephthalate) spun yarn (yarn count number: 30) and a poly (ethylene terephthalate) multi-filament yarn (165 dtex/36 filaments, fineness of single fiber: 4.6 dtex) were prepared as ground yarns. FIG. 5 represents a knitted pattern in the obtained cut pile knitted formation. In this knitted pattern, each yarn supplied from each feeder represented by feeder numbers <1> to <12> forms a loop 33 or a knitted base formation 34 from a ground yarn to a dial needle 31 and a cylinder needle 32. Specifically, in the knitted pattern represented by FIG. 5, knitting was performed by feeding the crimped fiber (A) to feeders <1>, <2>, <4>, <7>, <8> and <10>, respectively, the crimped fiber (A) and the flat fiber (B) to feeders <5> and <11> with drawing (bundling and drawing), respectively, and two kind of ground yarns to feeders <3>, <6>, <9> and <12> with drawing (bundling and drawing), respectively. The obtained cut pile knitted cloth has a formation represented by a schematic cross-sectional view illustrated in FIG. 6, and a crimped pile yarn 41 and a flat pile yarn 42 were knitted in a base cloth knitted with a ground yarn 43. The fabric weight of the knitted cloth was 1050 g/m. The number ratio of the tip obtained by cutting the crimped fiber (A) relative to the tip obtained by cutting the flat fiber (B) [the crimped fiber (A)/the flat fiber (B)] was 4/1.

A finishing was performed by brushing only the tips of the cut pile part of the obtained knitted cloth and coating the back side of the knitted cloth with an acrylic resin in an amount of 60 g/m$^2$ at 140° C. for backlining. In the knitted cloth, the average height of the flat fiber (B) was 7 mm, which was 2 mm longer than that of the crimped fiber (A).

The obtained fabric was wrapped around and attached to a roller of 13 mm in diameter and 16 cm in length (a cylindrical structure made of a polypropylene) represented by FIG. 3 to produce a window screen cleaner. The wiping property and usability of the window screen cleaner were evaluated. The results are shown in Table 1.

Comparative Example 1

The crimped fiber (A) was vacuum-treated at 90° C. for 10 minutes to give a pre-crimped thread. A cut pile knitted cloth was obtained in the same manner as in Example 1 except for supplying the pre-crimped thread to the circular knitting machine instead of the crimped fiber (A). In this manner the crimped fiber was prevented from thermally contracting in the backlining process. In the obtained knitted cloth, the average height of the flat fiber (B) was 7 mm, and there was no difference in average height between the flat fiber (B) and the treated crimped fiber (A).

TABLE 1

| | Wiping property | Usability |
|---|---|---|
| Example 1 | A | A |
| Comparative Example 1 | C | B |

As apparent from the results in Table 1, the window screen cleaner of Example 1 had a high wiping property, and dust or dirt on both the front and back sides of the window screen were wiped out by cleaning only one side of the window screen. Further, the window screen cleaner had an excellent usability and a reduced scattering of dirty water. In contrast, wiping one side of a window screen with the window screen cleaner of Comparative Example 1 moved dust or dirt to the other side of the window screen, so that the dust or dirt was insufficiently removed from the window screen. Further, the window screen cleaner of Comparative Example 1 scattered dirty water during its use.

What is claimed is:

1. A window-screen-cleaning fabric, comprising:

a base cloth and a plurality of fibers comprising (A) a crimped fiber and (B) a flat fiber, wherein the crimped fibers and the flat fibers are raised from a first surface of the base cloth, and the height of the flat fibers from the first surface of the base cloth is greater than that of the crimped fibers from the first surface of the base cloth, the crimped fiber (A) comprises a cut pile yarn of a multifilament, and the flat fiber (B) comprises a monofilament having a fineness of 100 to 500 dtex and an average aspect ratio of 5 to 30, wherein the average aspect ratio means a ratio of a length in a width direction relative to a length in a thickness direction of a cross-sectional form perpendicular to a longitudinal direction of the fiber.

2. A fabric according to claim 1, wherein the height of the crimped fibers (A) is almost uniform, the average height of the crimped fibers (A) is 2 to 10 mm, the height of the flat fibers (B) is almost uniform, and the average height of the flat fibers (B) is 1 to 5 mm larger than the average height of the crimped fibers (A).

3. A fabric according to claim 1, wherein the crimped fiber (A) comprises a hydrophilic fiber having a fineness of single fiber of not more than 5 dtex and a percentage of crimp of 5 to 30%.

4. A fabric according to claim 1, wherein the base cloth comprises a woven or knitted fabric, and the flat fiber (B) comprises a cut pile yarn of a monofilament.

5. A fabric according to claim 1, wherein the crimped fiber (A) and the flat fiber (B) are arranged for forming a pair of an array of the crimped fiber (A) and an array of the flat fiber (B) adjacent to each other, and the arrays are arranged parallely with each other at intervals.

6. A window screen cleaner, comprising:

a fabric recited in claim 1, a roller having the fabric wrapped therearound, and a handle member having a crooked rod attached to the roller, wherein the roller is rotatable about a rotation axis thereof.

7. A window screen cleaner according to claim 6, wherein the base cloth has a first engaging element formed on a second surface thereof and having a female structure of a separable fastener, the roller has a second engaging element formed on an outer surface thereof and having a male structure of the separable fastener, and the fabric is detachably attached to the roller with an aid of an engagement of the first and second elements.

* * * * *